US007439639B2

(12) United States Patent
Nitsche

(10) Patent No.: US 7,439,639 B2
(45) Date of Patent: Oct. 21, 2008

(54) SAFETY SWITCHING APPARATUS FOR SAFE DISCONNECTION OF AN ELECTRICAL LOAD

(75) Inventor: Thomas Nitsche, Esslingen (DE)

(73) Assignee: Pilz GmbH & Co. KG, Ostfildern (DE)

( * ) Notice: Subject to any disclaimer, the term of this patent is extended or adjusted under 35 U.S.C. 154(b) by 0 days.

(21) Appl. No.: 11/859,290

(22) Filed: Sep. 21, 2007

(65) Prior Publication Data

US 2008/0067877 A1 Mar. 20, 2008

Related U.S. Application Data

(63) Continuation of application No. PCT/EP2006/001935, filed on Mar. 3, 2006.

(30) Foreign Application Priority Data

Mar. 22, 2005 (DE) ..... 10 2005 014 122

(51) Int. Cl.
*H02H 11/00* (2006.01)
*H02H 3/00* (2006.01)

(52) U.S. Cl. ..... 307/326; 361/67

(58) Field of Classification Search ..... 307/326; 361/62, 21, 67

See application file for complete search history.

(56) References Cited

U.S. PATENT DOCUMENTS

| | | | | |
|---|---|---|---|---|
| 6,628,015 | B2 * | 9/2003 | Pullmann et al. | 307/326 |
| 7,130,171 | B2 * | 10/2006 | Pullmann et al. | 361/62 |
| 2002/0195883 | A1 | 12/2002 | Lazzaro | |
| 2003/0011250 | A1 | 1/2003 | Pullmann et al. | |
| 2006/0077613 | A1 | 4/2006 | Homung | |
| 2008/0067876 | A1 * | 3/2008 | Nitsche et al. | 307/326 |

FOREIGN PATENT DOCUMENTS

| | | |
|---|---|---|
| DE | 94 14 07.0 | 3/1995 |
| DE | 100 11 211 A1 | 9/2001 |
| DE | 100 29 828 C1 | 1/2002 |
| DE | 103 25 363 A1 | 1/2005 |
| EP | 0 241 270 | 10/1987 |
| EP | 0 948 015 A2 | 10/1999 |

OTHER PUBLICATIONS

Emergency Stop Relays, Safety Gate Monitors; Category 2, EN 954-1; Oct. 2002; 3 pages.

Safety-related parts of control systems; DIN EN 954-1; Mar. 1997; 34 pages.

* cited by examiner

*Primary Examiner*—Michael J Sherry
*Assistant Examiner*—Michael Rutland Wallis
(74) *Attorney, Agent, or Firm*—Harness, Dickey & Pierce, P.L.C.

(57) ABSTRACT

A safety switching apparatus for safe disconnection of an electrical load has at least one input for connecting a signaling device. The safety switching apparatus further has an evaluation and control unit and at least one switching element which can be controlled by the evaluation and control unit in order to interrupt an electrical power supply path to the load. The evaluation and control unit is designed to carry out functional tests at defined instances of time in order to check at least one switching function of the at least one switching element. Moreover, the at least one input for connecting the signaling device is further designed as an input for supplying a supply voltage required for operation of the at least one switching element.

18 Claims, 3 Drawing Sheets

SAFETY SWITCHING APPARATUS FOR SAFE DISCONNECTION OF AN ELECTRICAL LOAD

CROSS-REFERENCES TO RELATED APPLICATIONS

This application is a continuation of international patent application PCT/EP2006/001935, filed on Mar. 3, 2006 designating the U.S., which international patent application has been published in German language and claims priority from German patent application DE 10 2005 014 122.6, filed on Mar. 22, 2005. The entire contents of these applications are incorporated herein by reference.

BACKGROUND OF THE INVENTION

The present invention relates to a safety switching apparatus for safely shutting down an automated installation in case of a hazardous situation. More specifically, the invention relates to a safety switching apparatus for safe disconnection of an electrical load used in such an installation.

Safety switching apparatuses in terms of the present invention are used to shut-down a technical installation or a technical device completely or partially when this is necessary in order, for example, to prevent the installation or the device causing a danger to operating personnel. The safety switching apparatuses typically have one or more input terminals for connecting one or more signaling devices, such as emergency-off buttons, guard door switches or light barriers. On the output side, the safety switching apparatuses typically have at least one switching element, which can be used to interrupt an electrical power supply path to the installation or the device. Typically the entire safety circuit including the connected signaling devices is monitored for failsafe operation and, if appropriate, a safety disconnection is initiated.

As will be appreciated, the technical complexity of such safety switching apparatuses increases as the respective safety requirements become more stringent. By way of example, a safety switching apparatus in terms of the present invention should be able to shut-down the installation or the device even when the switching element on the output side of the safety switching apparatus has failed. In the case of a relay, for example, the relay contacts may be welded, so that the relay can no longer be opened. A transistor may break down and thus cause a short circuit which prevents interruption of the electrical power supply path to the load. In order to cope with such faults, safety switching apparatuses are generally designed with multiple channel redundancy, so that, for example, in the event of failure of one switching element, a redundant switching element arranged in series can interrupt the electrical power supply path. However, a redundant implementation itself does not ensure fail-safety, unless proper operation of the respective channels is tested from time to time.

German patent application DE 103 25 363 A1 discloses a safety switching apparatus having an evaluation and control unit which carries out regular disconnection tests during operation in order to check whether the switching elements on the output side are still able to interrupt the electrical power supply path to the load. The evaluation and control unit is designed with two-channel redundancy in order to cope with possible faults in the signal processing section of the safety switching apparatus.

Another example of a safety switching apparatus with two-channel redundancy is disclosed by German patent application DE 100 11 211 A1. In this case as well, the evaluation and control unit, which evaluates and monitors the signaling devices on the input side and drives the switching elements, is designed with two-channel redundancy.

The two known safety switching apparatuses are typical examples of implementations which comply with safety requirements in accordance with Category 3 or even Category 4 of European Standard EN 954-1 or similar safety requirements in accordance with ISO 13849-1 or IEC 61508. However, the predominantly redundant design of the known safety switching apparatuses is complex and expensive.

The assignee of the present invention has already marketed an emergency-off switching device under the brand name PNOZ® X1, which switching device has redundant relay contacts connected in series with one another in order to interrupt the electrical power supply path to an external load. Apart from this redundant relay contacts, however, the PNOZ® X1 is a single-channel device without any special diagnostic capabilities. Without additional measures, the PNOZ®X1 is therefore approved only for applications up to Safety Category 2 of European Standard EN 954-1. In addition, the PNOZ® X1 device requires a certain installation space, and it is desirable to reduce this installation space.

SUMMARY OF THE INVENTION

Against this background, it is an object of the present invention to provide a safety switching apparatus of the type explained before, which can be implemented physically smaller than previous safety switching apparatuses.

It is another object of the invention to provide a safety switching apparatus which allows to comply with the requirements for Category 3 of European Standard EN 954-1 or comparable safety requirements in accordance with ISO 13849-1 or IEC 61508, but at lower costs.

In view of the above, there is provided a safety switching apparatus for safe disconnection of an electrical load, said electrical load being connected to an electrical power supply path, the safety switching apparatus comprising at least one input for connecting a signaling device, an evaluation and control unit, and at least one switching element adapted to be controlled by the evaluation and control unit in order to interrupt the electrical power supply path, wherein the evaluation and control unit is designed to carry out functional tests at defined instances of time in order to check a switching position of the at least one switching element, and wherein the at least one input is further designed as an input for supplying an external supply voltage required for operation of the at least one switching element.

There is also provided a safety switching apparatus for safe disconnection of an electrical load in an automated installation, the safety switching apparatus comprising an input terminal for connecting a signaling device, an evaluation and control unit, and at least one switching element defining an electrical power supply path for supplying electrical power to the load, wherein the at least one switching element has a first and a second switching position different from the first switching position, wherein the evaluation and control unit is configured to control the switching positions by means of a supply voltage supplied to the at least one switching element, and the evaluation and control unit is also configured to check the switching positions at defined instances of time, and wherein the at least one input terminal is further designed to supply the supply voltage for the at least one switching element.

With the novel safety switching apparatuses, the input for connecting the signaling device is also used as an input for supplying the supply voltage required for operation of the at least one switching element. A signaling device is thus connected to the novel safety switching apparatus in such a way that, when the signaling device is operated, the supply voltage for the at least one switching element is also automatically interrupted. This can be implemented very easily for signaling devices which have one or more break contacts opened on operation of the signaling device. However, the invention is not restricted to this and may, for example, also be implemented for signaling devices which produce an output signal related to a fixed potential.

With the novel safety switching apparatus, the information (message signal from the signaling device) and the power for operation of the at least one switching element are passed at the same time and on the same path. Lack of the supply voltage for the at least one switching element is equivalent to the information that a safety requirement has occurred. In contrast to this, the supply voltage for the switching elements on the output side in typical conventional safety switching apparatuses complying with stringent safety categories is carried separately from the supply voltage for the switching element on the output side. Since the information (message signal from the signaling device) and the power are carried separately from one another in prior art apparatuses, relatively complex evaluation and control units are required, which ensure interruption of the electrical power supply path to the load as soon as the corresponding information (message signal from the signaling device) is present. Since the evaluation of the message signal is a safety-critical task, the evaluation and control units for the known safety switching apparatuses are typically designed with multiple-channel redundancy. This complexity is not required for the novel safety switching apparatus, which can thus be produced considerably more cost-effectively.

On the other hand, the novel safety switching apparatuses have an evaluation and control unit which is designed to carry out functional tests in order to monitor the switching function of the at least one switching element. In consequence, the novel safety switching apparatus differs from simple devices of lower safety categories, such as the PNOZ® X1 mentioned above. Since (in contrast to the PNOZ® X1) the novel evaluation and control unit, however, is no longer responsible on its own for the transmission of the information from the signaling device to the switching element on the output side, the evaluation and control unit may have only one channel, and can thus be designed to be relatively cost-effective.

In summary, the novel safety switching apparatus allows to comply with the requirements from Category 3 of European Standard EN 954-1 (or comparable safety requirements) since both redundant disconnection and defined functional tests of the switching elements are provided. On the other hand, the evaluation and control unit for the novel safety switching apparatus, which is responsible for carrying out the functional tests, can be produced considerably simpler and considerably more cost-effective than in the case of prior art safety switching apparatuses.

In a refinement, the at least one input is also designed to supply a supply voltage required for operation of the evaluation and control unit.

In principle, it would be feasible to supply the supply voltage for the evaluation and control unit via another (further) input. This would make it possible for the evaluation and control unit to remain in operation even when the signaling device signals a safety requirement and thus, according to the present invention, interrupts the supply voltage for the at least one switching element. The preferred refinement, however, can be produced more easily. This also allows an implementation with a small number of connecting terminals, so that, for example, the housing width of the novel safety switching apparatus can be reduced. Furthermore, this refinement means that the evaluation and control unit must necessarily be reinitialized after each safety requirement, and this can advantageously be used to subject the evaluation and control unit to a self-test.

In a further refinement, the safety switching apparatus comprises a decoupling network designed to decouple the supply voltage for the at least one switching element and the supply voltage for the evaluation and control unit from one another.

This refinement avoids any reaction from the load circuit on the evaluation and control unit. In consequence, the evaluation and control unit is better protected against disturbance influences from the outside, and against malfunctions caused by them.

In a further refinement, the decoupling network comprises a first delay element in order to delay the supply voltage for the at least one switching element relative to the supply voltage for the evaluation and control unit.

In this refinement, the supply voltages for the at least one switching element and the evaluation and control unit are not only decoupled from one another in the circuitry, but are also separated from one another in time. Since the evaluation and control unit receives its supply voltage "earlier" as a result of this refinement than the at least one switching element, this ensures that the evaluation and control unit can complete internal self-tests before it drives the at least one switching element. This provides even better prevention of incorrect enabling of the electrical power supply path to the load.

In a further refinement, the safety switching apparatus comprises a reset circuit designed to reset the evaluation and control unit into a defined start state whenever the supply voltage returns.

This refinement makes it easier to produce the evaluation and control unit with a (single-channel) microcontroller, microprocessor or the like. A reset, which is forced to occur whenever the voltage returns, ensures that the evaluation and control unit always starts from one and the same defined start position. This ensures that the evaluation and control unit runs completely through its self-tests on each occasion before the power supply path to the load is closed. As a result, the evaluation and control unit can easily be designed as a single-channel device.

In a further refinement, the evaluation and control unit is a single channel evaluation and control unit.

This refinement profits from the capabilities described above and allows a particularly cost-effective implementation of the novel safety switching apparatus.

In a further refinement, the evaluation and control unit comprises a microcontroller which is designed to carry out the functional tests at the defined instances of time, in particular prior to the closing of the electrical power supply path to the load.

The term "microcontroller" is used here synonymously for similar components whose functional scope at least can be defined by the manufacturer. It is therefore not restricted to microcontrollers in the narrow sense but also covers, for example, microprocessors with or without external memory or other programmable components. This refinement allows a particularly simple and cost-effective implementation of the novel safety switching apparatus, in which case the respective functional scope can be defined individually. This makes it possible, for example, to produce safety switching apparatuses cost-effectively which are intended for different types of signaling devices and/or in conjunction with different types of switching elements.

In a further refinement, the safety switching apparatus comprises a second delay element, which is designed to block a connection between the evaluation and control unit and the at least one switching element for a defined time interval measured from the application of the supply voltage.

This refinement also contributes to the prevention of premature and/or faulty closing of the electrical power supply path to the load, even when the at least one switching element is driven by a single-channel evaluation and control unit. In combination with the refinements which have already been described above, this results in even better safety when the load is started up.

In a further refinement, the novel safety switching apparatus comprises at least two switching elements arranged in series with one another in order to interrupt the electrical power supply path to the load on a redundant basis, with the evaluation and control unit being designed to produce a first dynamic control signal for a first of the at least two switching elements, and a second, in particular a static, control signal for the second of the at least two switching elements.

This refinement of the invention uses redundant switching elements in the load circuit in order to allow the load to be disconnected even when one of the switching elements fails during the switching process. Furthermore, the at least two redundant switching elements are, however, may be driven in a different manner from one another, that is to say with two control signals which differ from one another. Malfunctions of the novel safety switching apparatus are thus even less probable. It is particularly preferable for one of the control signals to be a dynamic signal, while the other control signal is a static signal. This is because both types of control signals can be produced very easily by a microcontroller or a comparable component, in which case simultaneous incorrect control of the redundant switching elements is extremely unlikely, owing to the different nature of the control signals.

In a further refinement, the at least one switching element is a changeover switch with at least two mutually alternative switching paths, with a first switching path being located in the electrical power supply path to the load, and with a second switching path leading to a monitoring unit.

This refinement allows particularly cost-effective production of the novel safety switching apparatus, in particular with outputs that are not related to a fixed potential. The reason is that the use of a changeover switch makes it possible to use "simple" changeover relays instead of more expensive and larger relays with positively guided make and break contacts. This refinement thus allows a very cost-effective and physically small safety switching apparatus by means of which it is nevertheless possible to comply with at least Category 3 of European Standard EN 954-1 or a comparable safety level.

It goes without saying that the features mentioned above and those which are still to be explained in the following text can be used not only in the respectively stated combination but also in other combinations or on their own without departing from the scope of the present invention.

BRIEF DESCRIPTION OF THE DRAWINGS

Exemplary embodiments of the invention will be explained in more detail in the following description and are illustrated in the drawing, in which.

DESCRIPTION OF PREFERRED EMBODIMENTS

Figure 1:
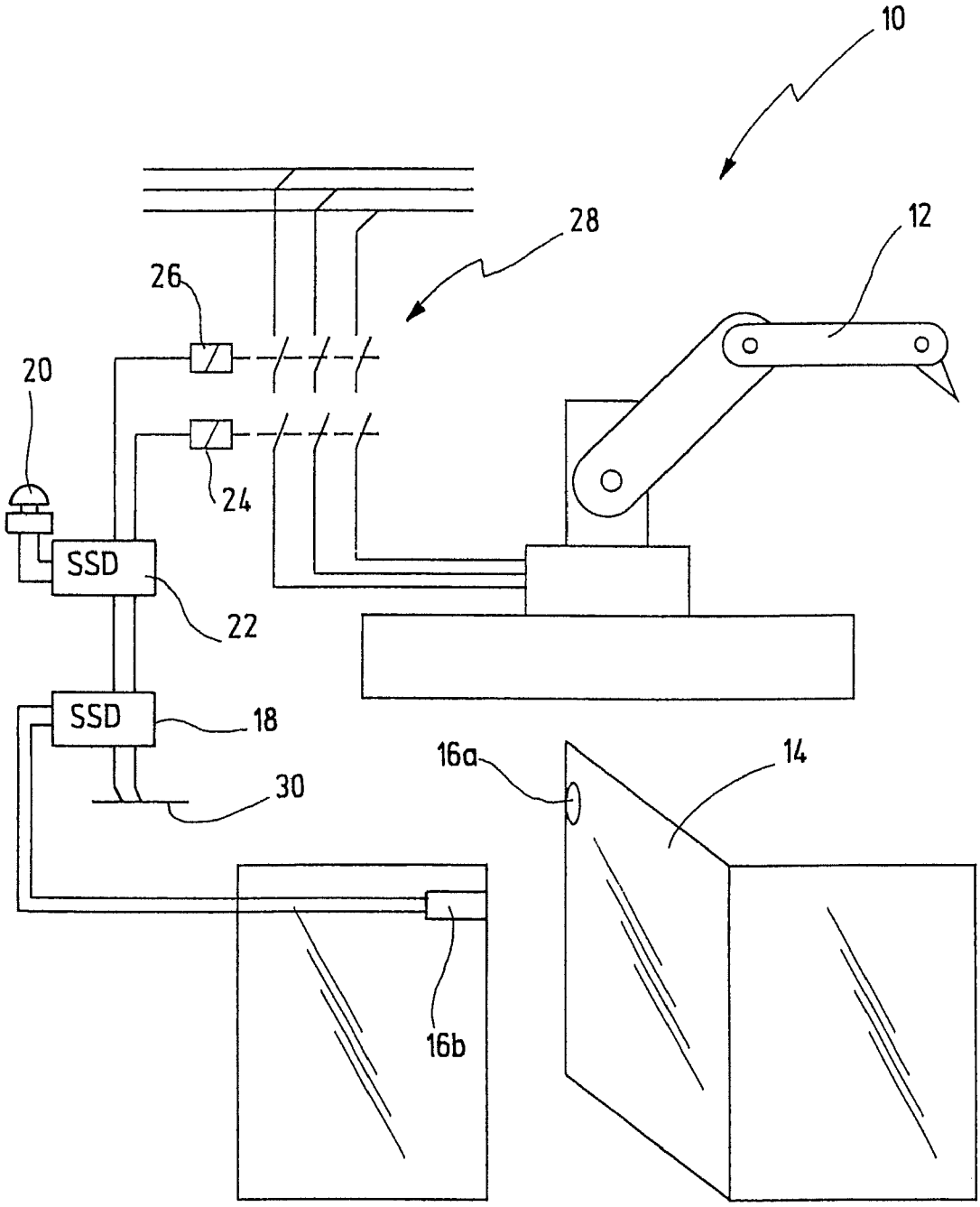
FIG. 1 shows a robot as an example of an installation which operates on an automated basis, with the novel safety switching apparatus.

In FIG. 1 an installation which operates on an automated basis and in which the novel safety switching apparatus is used, is designated by reference number 10.

In this case, the installation 10 comprises a robot 12 whose operating area is protected by a guard fence having a guard door 14. The open or closed position of the guard door 14 is detected by a guard door sensor 16. The guard door sensor comprises a first part 16*a* which is attached to the moving part of the guard door 14, and a second part 16*b* on the stationary frame of the guard door 14. In one exemplary embodiment, the first part 16*a* comprises a transponder, which can be identified and evaluated by the second part 16*b* (reader) only when the guard door is closed. However, the invention is not restricted to guard door sensors of this type and, furthermore, is also not restricted to guard door sensors as signaling devices. The invention can be used equally well with other signaling devices, such as emergency-off buttons, rotation-speed sensors, light barriers and others.

Reference number 18 denotes a safety switching apparatus according to the present invention. This safety switching apparatus is used to shut-down the robot 12 when the guard door 14 is opened.

The installation 10 is also shown here with an emergency-off button 20 as another signaling device. The emergency-off button 20 is evaluated by another safety switching apparatus 22 according to the present invention. The safety switching apparatuses 18 and 22 in the illustrated exemplary embodiment each have outputs that are not related to a fixed potential (which will be explained in more detail in the following text with reference to FIG. 2), which are connected in series with one another, in order to form an AND logic operation.

Two contactors 24, 26 are arranged at one end of the logic chain, in this case at the output of the safety switching apparatus 22, and their make contacts are once again connected in series with one another in an electrical power supply path 28 to the robot 12. The contacts of the two contactors 24, 26 are make contacts, that is to say they are closed only when the input circuits of the contactors 24, 26 are excited with an operating voltage which is higher than the pull-in or holding voltage of the contactors 24, 26. The operating voltage 30 is, for example, 24 volts and, in this exemplary embodiment, is looped through via the series-connected output contacts of the safety switching apparatus 18 and 22 to the contactors 24, 26. When the guard door 14 is opened and/or on operation of the emergency-off button 20, the safety switching apparatuses 18, 22 interrupt the current path via which the input circuits of the contactors 24, 26 are connected to the operating voltage 30. In consequence, the contactors 24, 26 trip, and the robot 12 is shut-down. The contactors 24, 26 and (indirectly) the robot 12 are thus loads in terms of the present invention.

It goes without saying that the installation 10 is illustrated here in a simplified form. In particular, only two simple safety circuits are illustrated here for shutting down the robot 12. In practice, there will typically be further safety circuits. For example, the contactors 24, 26 typically also have positively-opened break contacts which are fed back to at least one of the safety switching apparatuses 18, 22 in order to prevent starting of the robot 12 if one of the contactors 24, 26 has become welded. Furthermore, an operation control system (not illustrated here) is typically provided, and controls the normal operating procedure of the robot 12.

Figure 2:
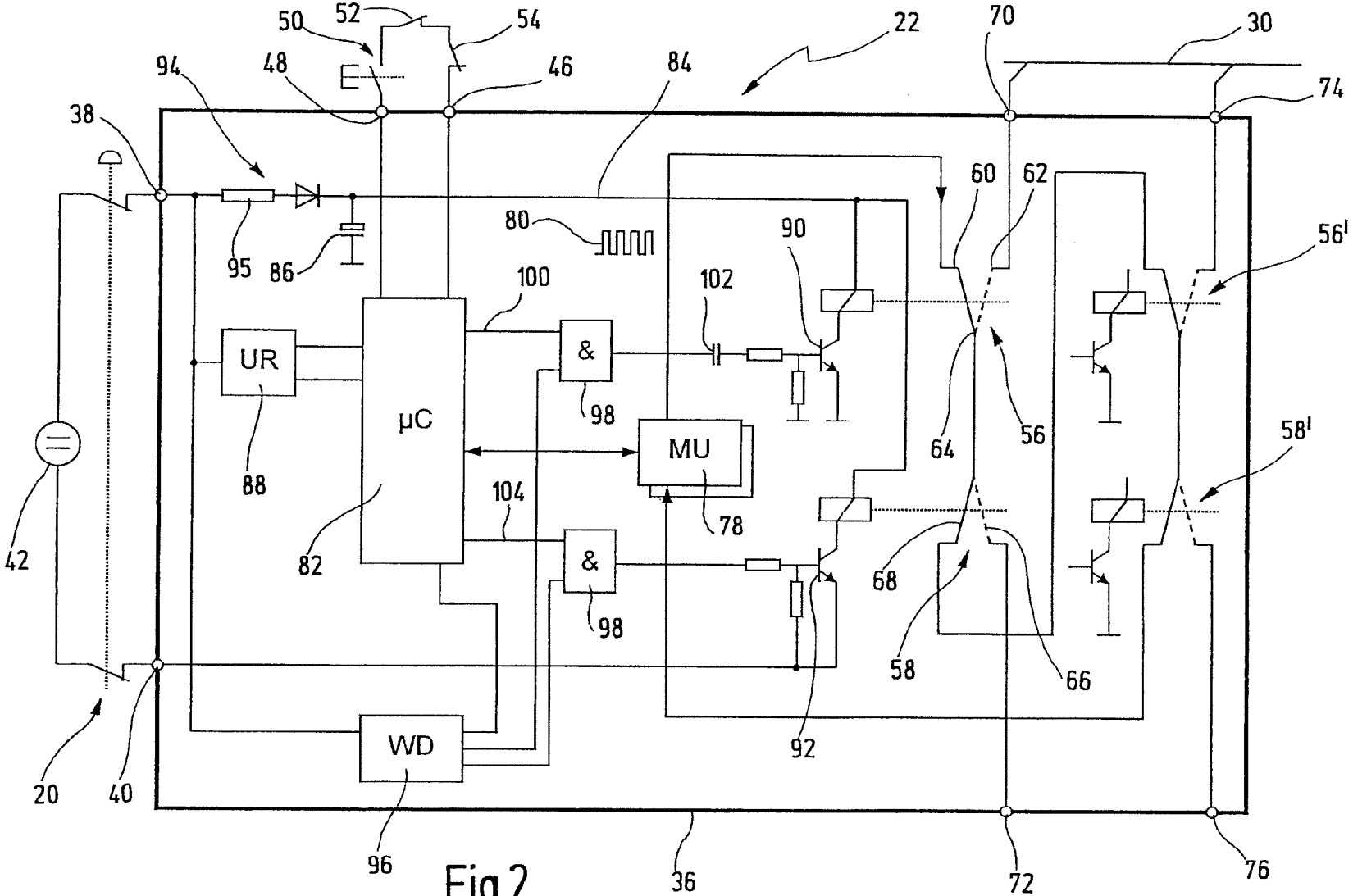
FIG. 2 shows a schematic illustration of an exemplary embodiment of the novel safety switching apparatus.

FIG. 2 shows further details of the safety switching apparatus 22. The safety switching apparatus 18 can in principle be designed in the same manner, or else may have a two-channel evaluation and control unit as well as outputs of a conventional type.

The components of the safety switching apparatus 22 are arranged in a manner known per se in a compact device housing 36. The housing 36 has terminals, for example in the form of screw terminals or spring terminals. Reference numbers 38, 40 denote two connections which in this case are used both for connecting the emergency-off button 20 and for supplying a supply voltage 42 for the safety switching apparatus 22. In this case, the supply voltage 42 is illustrated as a DC voltage, and is connected to the connections 38, 40 via a respective break contact of the emergency-off button 20. As an alternative to this, the voltage 42 could in principle also be an AC voltage.

Reference numbers 46, 48 denote two further connecting terminals, to which a series circuit comprising a start button 50 and two break contacts 52, 54 is connected. The break contact 52 belongs to the contactor 24 shown in FIG. 1 and is positively guided with the make contacts of the contactor 24. The break contact 54 is positively guided in the same manner with the make contacts of the contactor 26.

The safety switching apparatus 22 is illustrated here with a total of four switching elements 56, 56', 58, 58'. The switching elements 56, 58 and 56', 58' respectively are each connected in series with one another and may form two electrical power supply paths via which the two contactors 24, 26 can be driven. The second electrical power supply path with the switching elements 56', 58' is illustrated only partially for sake of clarity, in particular without the details relating to the drive for the switching elements 56', 58'. However, the switching elements 56', 58' are driven in the same manner as the drive for the switching elements 56, 58. For this reason, the following explanatory notes also relate to the switching elements 56', 58', unless stated to the contrary.

In this case, the switching elements 56, 58 are in the form of changeover switches. Each switching element 56, 58 has three connections 60, 62, 64 which in this case are indicated only for the switching element 56, for sake of clarity. The three connections 60, 62, 64 form two mutually alternative switching paths. A first switching path 66 runs between the connections 62 and 64 (represented by a dashed line in FIG. 2). A second, alternative switching path 68 runs from the connection 60 to the connection 64 (represented by a solid line). The connection 64 thus forms a common root for the alternative switching paths 66, 68. Only one of the switching paths 66, 68 may in each case be closed at any one time. The other is open then.

The changeover switches 56, 58 in one exemplary embodiment of the invention are changeover relays each having one contact which is switched between the connections 60, 62. In further exemplary embodiments, the changeover switches may, however, also be in the form of semiconductor switching elements, or at least may be implemented by means of semiconductor switching elements.

The connection 62 of the switching element 56 is connected to one terminal 70 on housing 36 of the safety switching apparatus 22. The connection 66 of the switching element 58 is connected in the same manner to an external terminal 72 of the safety switching apparatus 22. The roots 64 of the two switching elements 56, 58 are connected in series with one another. The first switching paths 66 of the two switching elements 56, 58 thus provide an electrical power supply path between the connections 70, 72 of the safety switching apparatus 22, which can be closed or interrupted as a function of the switch position of the switching elements 56, 58. In the same manner, the switching elements 56', 58' represent a second electrical power supply path between the connecting terminals 74, 76 of the safety switching apparatus 22. In the application shown in FIG. 1, the contactors 24, 26 are connected to the connecting terminals 72, 76. The operating voltage 30 is applied to the connections 70, 74 and, possibly in the same manner as that described here, is looped through the safety switching apparatus 18.

The second switching paths 68 of all four switching elements 56, 56', 58, 58' are in this exemplary embodiment connected in series with one another, and this series circuit is connected to a monitoring unit, which is designated by reference number 78 in FIG. 2. The monitoring unit 78 may have two channels, as is indicated schematically in FIG. 2. However, it is also possible for the monitoring unit 78 to be implemented with a single channel. The purpose of the monitoring unit 78 is to feed a test signal 80 to the series circuit formed by the second switching paths 68 of the switching elements 56, 58, 56', 58'. If the monitoring unit 78 can read the test signal 80 back via the switching paths, this means that all of the switching elements are in the switch position shown in FIG. 2. The electrical power supply paths to the contactors 24, 26 are thus interrupted.

The monitoring unit 78 is connected to a microcontroller 82, which represents an evaluation and control unit in terms of the present invention. According to one preferred exemplary embodiment, only one microcontroller 82 is provided, although the invention is not restricted to this. The microcontroller 82 is designed to set the switch position of the switching element 56, 58, 56', 58'. Furthermore, it carries out functional tests in the manner which will be described in the following text, in order to check the switching operation of the switching elements 56, 58, 56', 58'.

In order to switch, the switching elements 56, 58 require a supply voltage, which is applied to a line 84 or to a capacitor 86. In this case, the supply voltage at 84, 86 largely corresponds to the supply voltage 42 which is applied to the terminals 38, 40 of the safety switching apparatus 22. The voltage on the line 84 is passed via the input circuits of the switching elements 56, 58 and via a respective transistor 90, 92. The transistors 90, 92 allow the microcontroller 82 to close or to interrupt the excitation circuit for each switching element 56, 58. When the excitation circuit is closed and a supply voltage higher than the pull-in voltage of the switching elements 56, 58 is applied to the capacitor 86 or to the line 84, the changeover switches are switched to the first switching path 66. If there is either no supply voltage on the line 84 (or the voltage in this case falls below the holding voltage of the switching elements) or the microcontroller 82 interrupts the excitation circuit by means of the transistors 90, 92, the switching elements return to their default switch position, in which the second switching path 68 is closed. The electrical power supply paths to the contactors 24, 26 are then interrupted.

Reference number 88 denotes a voltage and reset circuit which in this case comprises a voltage regulator (not illustrated separately) which uses the general supply voltage 42 to produce an individual supply voltage for the microcontroller 82. In addition, the voltage and reset circuit 88 ensures that the microcontroller 38 starts in a defined manner whenever the voltage returns at the terminals 38, 40 (reset function). In one exemplary embodiment, the voltage and reset circuit thus also contains a pulse generator (not illustrated separately), which is connected to a reset input of the microcontroller 82.

The supply voltages for the microcontroller 82 and for the switching elements 56, 58 are thus both derived from the supply voltage 42 which is applied to the input of the safety switching apparatus 22. A decoupling network 94 is provided in order to decouple the two internally isolated supply voltages, and in the present exemplary embodiment decoupling network 94 contains a diode and a resistor 95 forming an RC element together with the capacitor 86. The resistor 95 governs the charging time for complete charging of the capacitor 86. The RC element comprising the resistor 95 and the capacitor 86 thus form a delay element which ensures that the supply voltage for the switching elements 56, 58 is reached only after a specific delay, measured from the application of the supply voltage 42 to the terminals 38, 40.

Reference number 96 denotes a so-called watchdog, which contains a second delay element. The watchdog 86 is used on the one hand to monitor the operation of the microcontroller 82, in a manner which is known per se. For this purpose, the watchdog 96 waits for regularly recurring pulses, which must be supplied from the microcontroller 82. Furthermore, the watchdog 86 is connected to a plurality of AND gates 98, by means of which it can suppress the transmission of the control signals from the microcontroller 82 to the transistors 90, 92.

In this exemplary embodiment, the switching elements 56, 58 are driven differently, that is to say by control signals which differ from one another. The switching element 56 (and the switching element 56') is (are) in this case driven by a dynamic control signal (a defined pulse train), which the microcontroller 82 produces at an output 100. The control signal 100 is passed via an AND gate and a capacitor 102 to the transistor 90. The transistor 90 is switched on only when the microcontroller 82 produces the pulse train at the output 100 at the intended frequency and with the intended amplitude, and when the watchdog 96 passes this pulse train to the capacitor 102.

In contrast, the switching elements 58, 58' are driven by the microcontroller 82 by means of a static signal 104. As an alternative to this, the switching elements 56, 58 could also each be driven with a dynamic signal or could each be driven with a static signal, in which case it is generally preferable for the control signals 100, 104 to differ from one another.

The following faults have to be taken into account in a fault analysis of the changeover switches 56, 58 in accordance with IEC 62061:

1. The changeover switches 56, 58 might remain in the excited (first) switch position 66, even though the input circuit is de-energized (not driven).
2. The changeover switches 56, 58 might not change to the first switch position 66, but remain in the second default switch position 68, despite excitation of the input circuit.
3. There might be a short between all of the connections 60, 62, 64.

These faults can be coped with by the monitoring unit 78 testing the switching operation of the changeover switches 56, 58 together with the microcontroller 82, before the electrical power supply path to the load is closed. For this purpose, the monitoring unit 78 produces the test signal 80, and feeds it to the series circuit comprising the second switching paths 68. If all of the connected changeover switches are in their de-energized default state, the monitoring unit 78 must be able to read back the test signal 80. In the next step, the changeover switch 56, by way of example, is now switched over by the microcontroller 82. Now, it must no longer be possible to read back the test signal 80 if the switching of the changeover switch has taken place without any faults and there is no short circuit between the connections 60, 62, 64. Once this test has been passed, the monitoring unit checks the other changeover switches successively. If the test signal 80 in one of the test cases can be read back, one of the above-mentioned faults has occurred. The monitoring unit 78 informs the microcontroller 82 as appropriate, preventing closure of the electrical power supply path to the contactors 24, 26. If, in contrast, all of the changeover switches pass the test, the electrical power supply path to the contactors 24, 26 can be closed. If one changeover switch were not to switch over to the first switching path 66 in this case, it would not be possible to switch on the connected load. A safe state would thus be ensured despite the (untested) fault.

Figure 3:
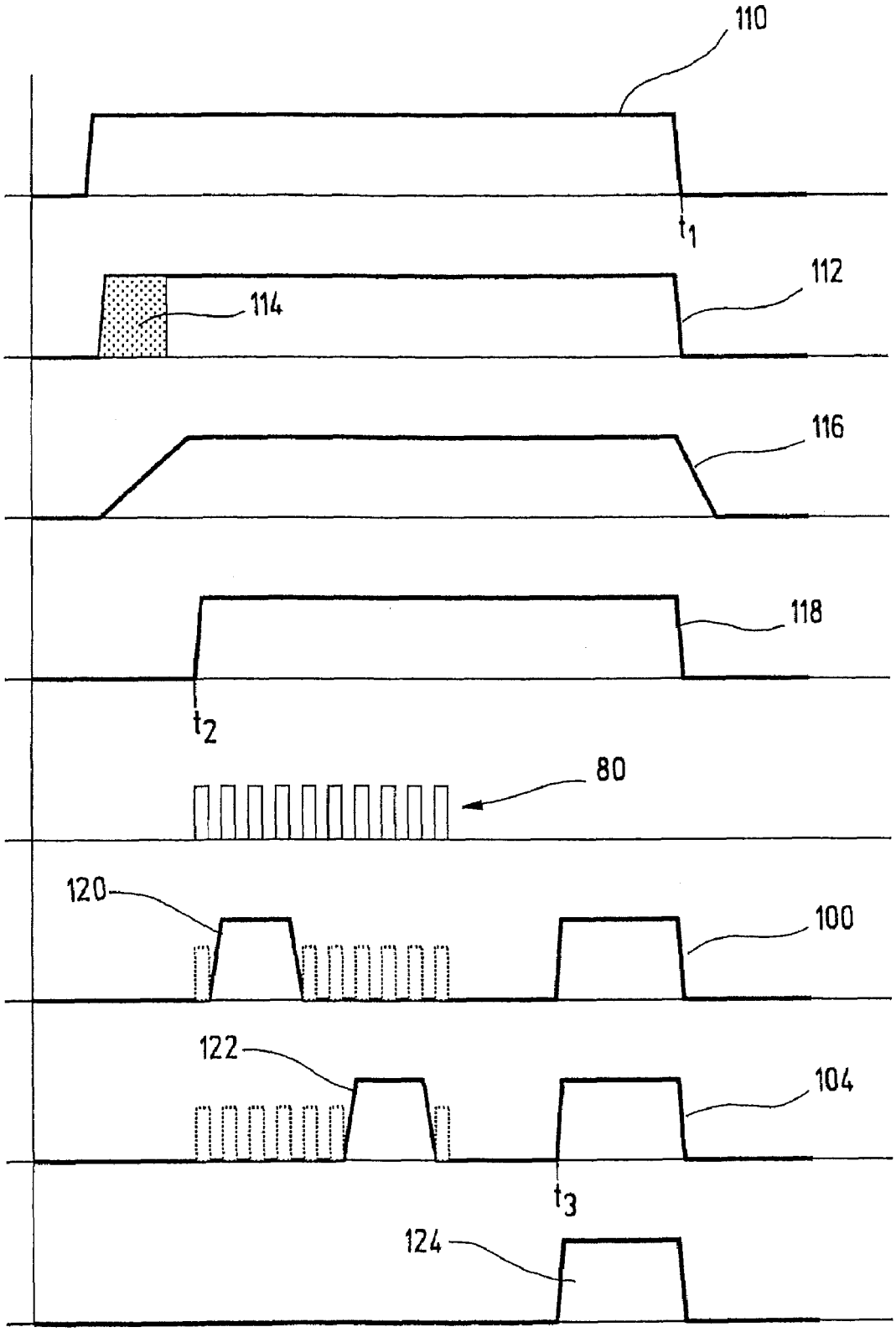
FIG. 3 shows a number of timing diagrams in order to explain the method of operation of one exemplary embodiment of the novel safety switching apparatus.

This method of operation is illustrated graphically once again in the timing diagrams in FIG. 3. The topmost time profile 110 shows the application of the supply voltage 42 to the safety switching apparatus 22, either when the overall installation is switched on or on closure of the emergency-off button 20. It is assumed that the emergency-off button 20 is operated at a time $t_1$, so that the supply voltage 42 is disconnected from the safety switching apparatus 22.

The second time profile 112 shows the supply voltage for the microcontroller 82, which is produced by means of the voltage and reset circuit 88. During a first time interval 114 after the application of the supply voltage to the microcontroller 82 (or after a reset), the microcontroller 82 carries out internal functional tests, as is known from operation of microcontrollers in safety switching apparatuses.

The third time profile 116 shows the profile of the supply voltage at the excitation circuits of the switching elements 56, 58. In this case, the voltage supplied initially rises more slowly, because of the time response of the RC delay element 95, 86. The components are chosen such that the supply voltage to the switching elements 56, 58 is not fully applied until the microcontroller 82 has completed its internal self-test.

The fourth time profile 118 shows the output signal at the watchdog 96. This signal is used to connect the outputs 100, 104 of the microcontroller 82 to the transistors 90, 92 to the switching elements 56, 58. The microcontroller 82 therefore cannot drive the switching elements 56, 58 until the time $t_2$.

The fifth profile shows the test signal 80, which the monitoring unit 78 feeds into the circuit comprising the second switching paths 68.

The control signals 100 and 104 for the switching elements 56, 58 are then shown in the next two profiles. First of all, a control signal is respectively activated for a time interval 120 or 122, with the time intervals 120, 122 being offset with respect to one another. In addition, the control signals occur simultaneously with the test signal 80 in the time intervals 120, 122. If the test signal 80 can no longer be read back by the monitoring unit 78 during the time intervals 120 or 122, as is indicated schematically in FIG. 3, the switching of the corresponding switching element 56, 58 was successful. After successful completion of the tests, the microcontroller 82 can switch the switching elements 56, 58 to their first switch position 66, and can close the electrical power supply paths to the contactors 24, 26 in this way (time $t_3$).

The lowermost diagram, finally, shows the profile 124 of the operating voltage 30 on the input circuits of the contactors 24, 26. The contactors 24, 26 can pull in after the time $t_3$, and the robot 12 can start to operate. If the emergency-off button 20 is operated at the time $t_1$, the supply voltage for the switching elements 56, 58 disappears (after a discharge time for the capacitor 86, which is ignored here). Furthermore, the control signals 100, 104 for the switching elements 56, 58 disappear. Both events result in the electrical power supply path to the contactors 24, 26 being interrupted.

In further exemplary embodiments, the functionality of the monitoring unit 78 can be at least partially integrated in the microcontroller 82. For example, it is preferable for the test signal 80 from the microcontroller 82 to be injected into the monitoring circuit of the second switching paths via an optocoupler, a capacitive coupling or an inductive coupling. The part which is annotated here as the monitoring unit 78 may then, for example, comprise the optocoupler or a transformer.

Furthermore exemplary embodiments of the invention may include the changeover switches 56, 58 each having a plurality of parallel switching contacts. In this case, the read-back paths for the monitoring unit 78 may be connected in parallel.

Furthermore, it is possible that the changeover switches 56, 58 each have a dedicated monitoring unit 78, which produces a specific test signal for the respective changeover switch. The large number of monitoring units can then be connected to the microcontroller 82 in order to signal the results of the functional tests to the microcontroller 82. Furthermore, the second switching paths of the changeover switches 56, 58 may be connected to one another in series, while the second switching paths of the changeover switches 56', 58' form a second series circuit, which is formed separately from the series circuit comprising the changeover switches 56, 58.

Finally, the present invention can also be implemented using "conventional" switching elements at the output of the safety switching apparatus 22, irrespective of whether these are positively-guided relays or semiconductor switching elements, as disclosed in DE 100 11 211 A1.

What is claimed is:

1. A safety switching apparatus for safe disconnection of an electrical load, said electrical load being connected to an electrical power supply path, the safety switching apparatus comprising at least one input for connecting a signaling device, an evaluation and control unit, and at least one switching element adapted to be controlled by the evaluation and control unit in order to interrupt the electrical power supply path, wherein the evaluation and control unit is designed to carry out functional tests at defined instances of time in order to check a switching position of the at least one switching element, and wherein the at least one input is further designed as an input for supplying an external supply voltage required for operation of the at least one switching element.

2. The safety switching apparatus of claim 1, wherein the evaluation and control unit is also operated with the external supply voltage from the at least one input.

3. The safety switching apparatus of claim 2, wherein a first and a second internal supply voltage is derived from the external supply voltage, with the first internal supply voltage being supplied to the evaluation and control unit, and with the second internal supply voltage being supplied to the at least one switching element.

4. The safety switching apparatus of claim 3, further comprising a decoupling network designed to decouple the first and second internal supply voltages from one another.

5. The safety switching apparatus of claim 4, wherein the decoupling network comprises a first delay element for delaying the second internal supply voltage relative to the first internal supply voltage.

6. The safety switching apparatus of claim 1, further comprising a reset circuit designed to reset the evaluation and control unit into a predefined starting state whenever the external supply voltage returns.

7. The safety switching apparatus of claim 1, wherein the evaluation and control unit is a single-channel evaluation and control unit.

8. The safety switching apparatus of claim 1, wherein the evaluation and control unit comprises a microcontroller for carrying out the functional tests at the defined instances of time.

9. The safety switching apparatus of claim 1, wherein the functional tests are carried out prior to each closing of the electrical power supply path.

10. The safety switching apparatus of claim 1, further comprising a second delay element designed to block a connection between the evaluation and control unit and the at least one switching element for a defined time interval measured from the application of the external supply voltage.

11. The safety switching apparatus of claim 1, further comprising at least two switching elements arranged in series with one another in order to interrupt the electrical power supply path on a redundant basis.

12. The safety switching apparatus of claim 11, wherein the evaluation and control unit is designed to produce a first control signal for a first of the at least two switching elements, and to produce a second control signal for the second of the at least two switching elements, with the first and second control signal being different from one another with respect to their respective signal characteristics.

13. The safety switching apparatus of claim 12, wherein the first control signal is a dynamic control signal, and the second control signal is a static control signal.

14. A safety switching apparatus for safe disconnection of an electrical load in an automated installation, the safety switching apparatus comprising an input terminal for connecting a signaling device, an evaluation and control unit, and at least one switching element defining an electrical power supply path for supplying electrical power to the load, wherein the at least one switching element has a first and a second switching position different from the first switching position, wherein the evaluation and control unit is configured to control the switching positions by means of a supply voltage supplied to the at least one switching element, and is configured to check the switching positions at defined instances of time, and wherein the at least one input terminal is further designed to supply the supply voltage for the at least one switching element.

15. The safety switching apparatus of claim 14, wherein the evaluation and control unit is also supplied with the supply voltage from the input terminal.

16. The safety switching apparatus of claim 14, further comprising a reset circuit designed to reset the evaluation and control unit into a defined starting state whenever the supply voltage is applied to the input terminal.

17. The safety switching apparatus of claim 14, wherein the evaluation and control unit is a single-channel evaluation and control unit.

18. The safety switching apparatus of claim 1, wherein the evaluation and control unit comprises a microcontroller designed to trigger the functional tests at defined instances of time.

* * * * *